United States Patent [19]

Hoag

[11] 3,979,485

[45] Sept. 7, 1976

[54] PORTABLE HUMIDIFIER

[75] Inventor: Kip J. Hoag, Concord, Mich.

[73] Assignee: McGraw-Edison Company, Elgin, Ill.

[22] Filed: Feb. 21, 1975

[21] Appl. No.: 579,383

Related U.S. Application Data

[63] Continuation of Ser. No. 412,710, Nov. 5, 1973, abandoned.

[52] U.S. Cl. ..... 261/30; 261/92; 312/284; D6/167; D23/146

[51] Int. Cl.[2] ..... B01F 3/04

[58] Field of Search ..... 261/24, 28, 29, 30, 261/80, 92; 312/31.1, 31.2, 31.3, 21, 22, 204, 247, 249, 272, 7, 284; 55/228; D6/167, 168; D23/143, 146, 149

[56] References Cited

UNITED STATES PATENTS

| | | | |
|---|---|---|---|
| 1,984,135 | 12/1934 | Houston | 55/228 X |
| 2,584,618 | 2/1952 | Robic | 261/92 |
| 3,290,021 | 12/1966 | Blachly et al. | 261/29 |
| 3,348,821 | 10/1967 | Martin et al. | 261/29 |
| 3,588,212 | 6/1971 | Gersch et al. | 312/204 |
| 3,598,370 | 8/1971 | Hoag | 261/30 X |
| 3,610,589 | 10/1971 | Paulin | 261/92 X |
| 3,615,075 | 10/1971 | Heiman et al. | 261/80 X |
| 3,628,312 | 12/1971 | Stoop et al. | 261/92 X |
| 3,637,194 | 1/1972 | Swimmer et al. | 261/92 X |
| 3,730,497 | 5/1973 | Schmitt et al. | 261/92 X |

*Primary Examiner*—Tim R. Miles
*Assistant Examiner*—Richard L. Chiesa
*Attorney, Agent, or Firm*—Charles F. Lind

[57] ABSTRACT

A portable humidifier having readily separable water container and decorative case components, where the container is caster supported for easy mobility and where the case has side walls defining an open bottom interior larger than the container suited to fit vertically over the container thereby virtually hiding same and then be removably supported in place thereon, optionally even with no mechanism latch connection thereto, and humidifying mechanism supported by the case operable to vaporize container water for discharge to the ambient atmosphere.

4 Claims, 6 Drawing Figures

PORTABLE HUMIDIFIER

This case is a continuation of application Ser. No. 412,710 filed Nov. 5, 1973, and now abandoned.

This invention relates to a portable humidifier for domestic or office use, and pertains to the manner of assembly and cooperation of the decorative case and the water container and associated humidifying mechanism. This application is related to my co-filed application entitled PORTABLE HUMIDIFIER HAVING SNAP TOGETHER CASE CONSTRUCTION.

A portable humidifier typically has a case within which a water container is located, and humidifying mechanism is supported within the case effective to dissipate container water as vapor to the surrounding environment. The trend is toward decorative cases simulating quality pieces of furniture thereby accommodating use in almost any room in the home or office. Some cases are fabricated by welded or bolted connections of separate panels of metal or plastic typically, and some are of molded plastic pieces. The pan-like water container can be separate from the case or can be defined as part of the case itself. The outside of the case frequently is grained and/or vinyl covered to give a decorative wooden appearance, or separate decorative overwrap panels can be secured in place covering the case. This later mentioned construction is shown in my U.S. Pat. No. 3,588,212, issued June 28, 1971.

Special concern must be given to the in-the-field cleaning of the humidifier after it has been in use. Typically a humidifying mechanism including a wetted porous mat is subjected to a moving air stream, and the resultant water evaporation leaves chemical deposits on the humidifying mechanism and/or on the container walls; and dust and lint from the air are also caught on the humidifying mechanism. It consequently is necessary to remove the humidifying mechanism for cleaning, and this can be done with varying degrees of ease with most humidifier designs. However, cleaning the water containers of some units can be quite difficult, particularly where the container is an integral part of the case or is virtually trapped by the fabrication of the case.

The main object of this invention is to provide a portable humidifier having separate container and case components where the case has side walls defining an open bottom interior sufficiently large to fit completely over and hide the container while the case then merely rests on the container, and further where appropriate humidifying mechanism is supported in the case and is readily removable from the container.

Other objects and advantages of this invention will be more fully understood and appreciated after reference to the accompanying drawings, wherein.

Figure 1:
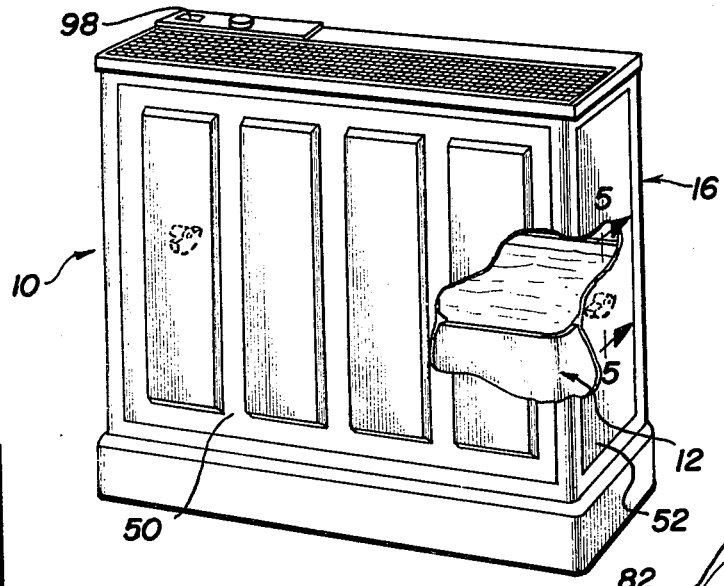
FIG. 1 is a perspective view, partly broken away for sake of clarity, of a portable humidifier made according to the subject invention.

Referring to the drawings, the disclosed humidifier 10 has a container 12 supported on four casters 14, a case 16 supported on the container 12, and a humidifying mechanism 18 supported in the case. The humidifying mechanism 18 shown is of the drum type having a drum 20 with an open periphery except for spaced cross bars 22 which support in place a circumferential mat 24 of porous humidifying material. The drum support includes engagement of inner circular edge 26 on the spaced rolls 28 and 30 and the drum face 32 against metal clips 34 snapped in place on the adjacent case ledge 36. A small synchronous motor 38 powers the roll 28 so that the drum rotates about a horizontal axis, and the drum is typically supported so that the lower drum portion passes through water in the container and the upper air exposed drum portion thus is continuously being wetted. A motor powered fan 40 supported in case opening 42 draws in outside ambient air and forces it through the wetted mat 24 for discharge from case vent 44 to the surrounding atmosphere.

Referring to specific details of case construction, the case 16 is generally rectangular in shape and is comprised of a front wall 50, a pair of side walls 52, and a rear wall 54. An upper lip 56 in the rear wall 54 comprises part of the top case wall, and a removable grill 58 rests on spaced ledges 60 formed from the front, side and rear walls defining the vent opening 44, and this grill in turn completes the top case wall. The pan-like container 12 shown has a bottom wall 62 and upstanding side walls 64 connected together to an open top. The bottom wall of the container has recessed corners 66 to receive the casters 14 while yet supporting the container closely adjacent the flat supporting surface on which the casters ride, and reinforced portions 68 of the bottom wall over the recesses provide bolt seats for holding the casters in place.

Figure 5:
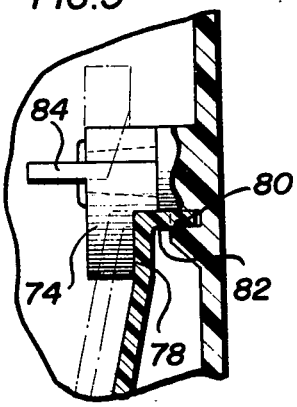
FIG. 5 is a sectional view, taken from line 5—5 in FIG. 1, showing details of a releasable latch suited for use with the subject humidifier.
Figure 6:
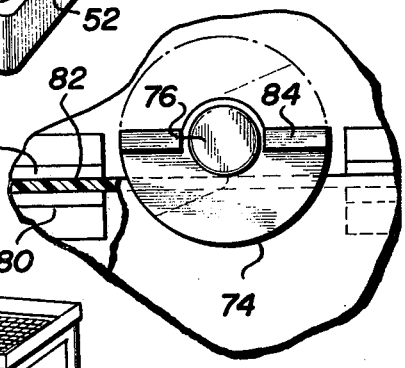
FIG. 6 is a right side elevational view of the latch construction shown in FIG. 5.
Figure 2:
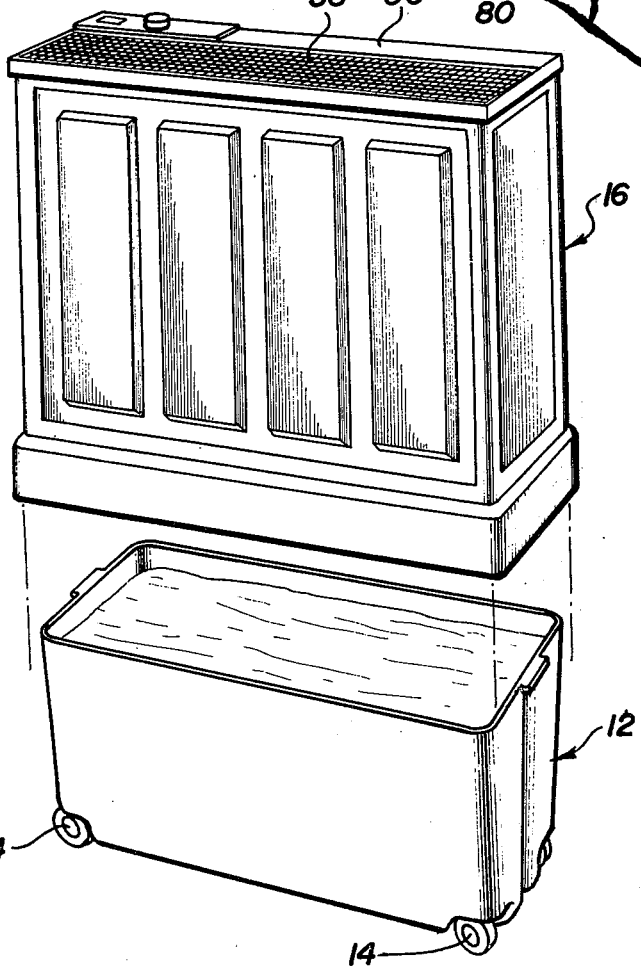
FIG. 2 is a perspective view similar to FIG. 1, except showing the case lifted off of the water container.
Figure 4:
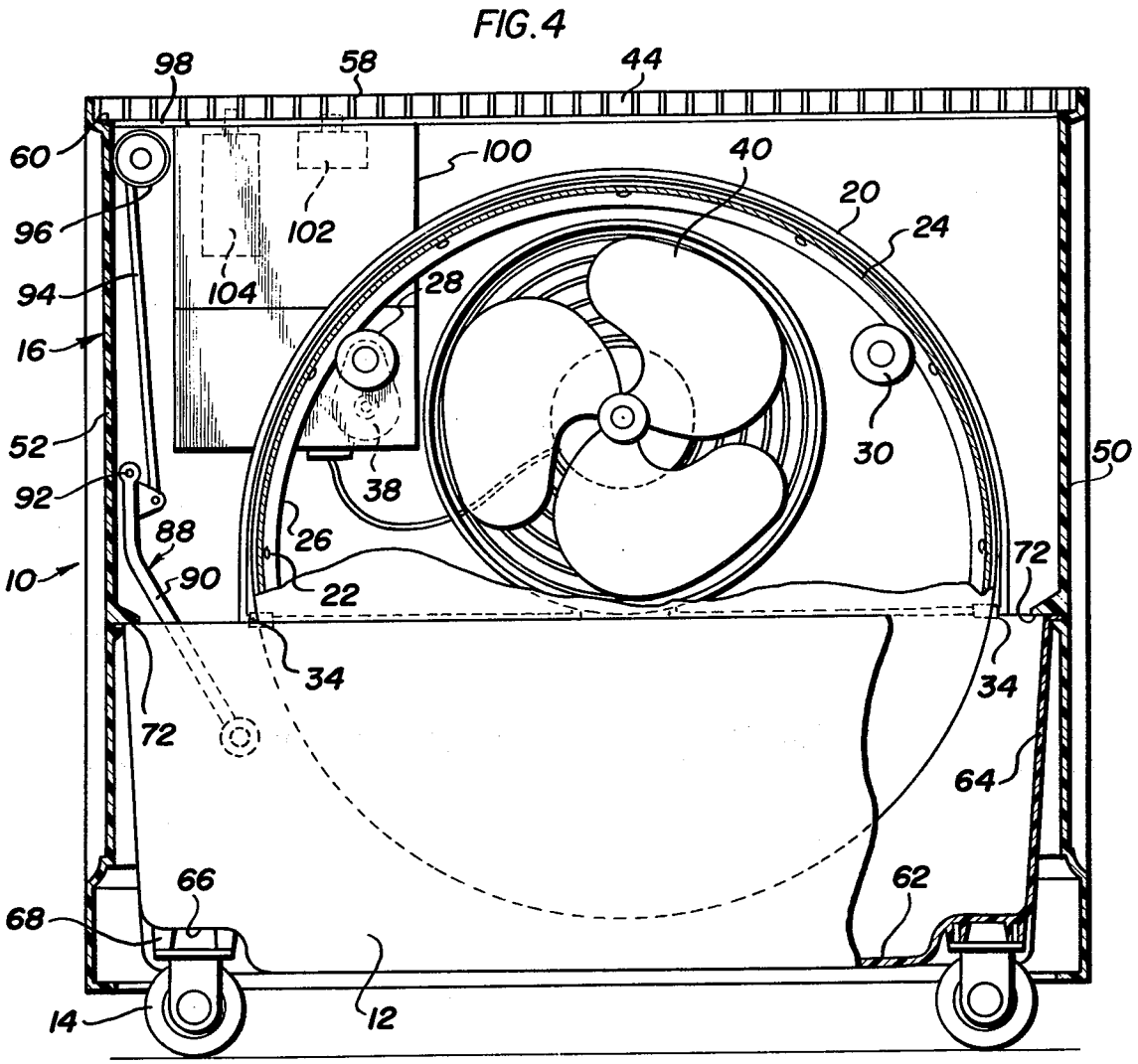
FIG. 4 is a sectional view of the subject humidifier, as seen generally from line 4—4 in FIG. 3.
Figure 3:
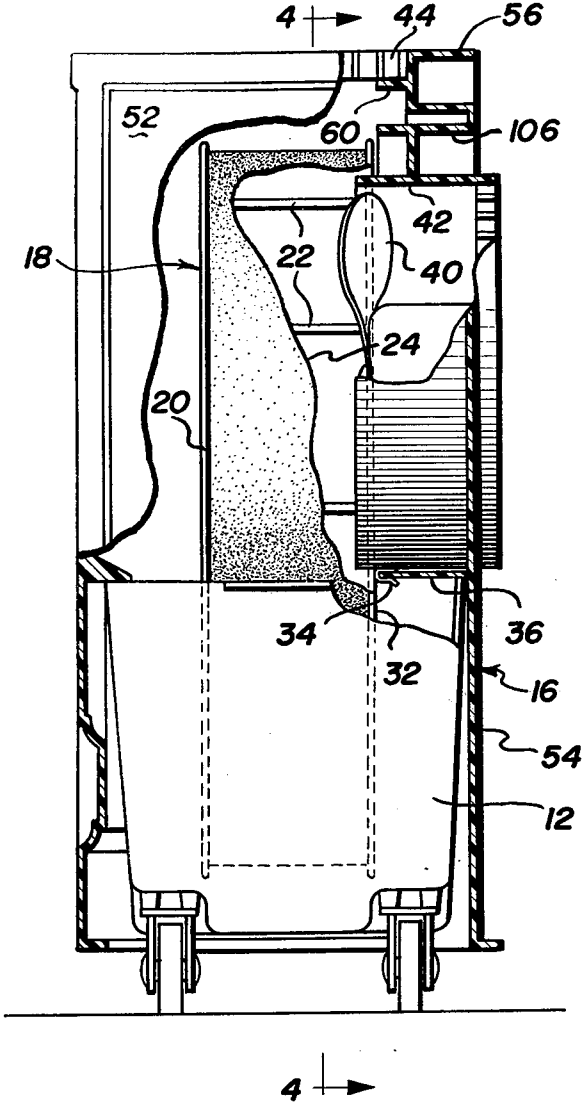
FIG. 3 is an end elevational view, partly broken away and/or in section, of the humidifier of FIG. 1.

The case 16 has no bottom wall to define within the front, side, and rear walls a bottom open interior that is larger than the container to thereby allow the case to be fitted over the container whereby the container is virtually hidden. Ledges 72 are inwardly directed from the case walls to a point beyond the container to support the case on the container at an elevation where the bottom case walls are slightly above the supporting surface. Normally, the case is thus supported on the container and no mechanical connections are needed between the container and case. However, if mechanical securement of the container and case is desired, it is possible to utilize a pair of cam-type latches 74 such as shown in FIGS. 5 and 6. Each latch has a generally crescent shaped body pivoted about pin 76 to the case wall, and a cam face 78 is formed on the latch adjacent the case. When the latch is rotated to its upper unlocked position, the latch is clear of the container wall and the container wall is just slightly smaller than a lower ledge 80 on the case. However, when the case is in position on the container and the latch is rotated approximately one-half turn, the cam face will engage the inner side of the container wall and deflect the same outwardly towards the case, where a small lip 82 on the container can be urged in the recess defined between the ledges 72 and 80 to firmly lock the case and container together. Tabs 84 formed on the back side of the body can be used for any manual manipulation of the latch.

It is noted that all of the humidifying mechanism is carried by the case and is virtually free of any connection with or to the container. In this regard, the liquid level float control 88 can include a float arm 90 pivoted at pin 92 to the case with linkage 94 being directed to a indicator drum 96 pivoted to the case and visible through an opening 98 in the case top wall. The power supply cord is connected within box 100 defined by appropriate case wall panels in appropriate circuits with on-off switch 102 and humidistat 104 located therein and with the float control switch, fan motor, roller motor and the like components located outside of the box.

It will be somewhat readily apparent that when the case is in place on the container, the humidifier can be operated in the normal manner, and caster support of the container allows for easy mobility as desired by the user. Should it become necessary to clean or otherwise service the humidifier, the entire case including all of the humidifying mechanism can be easily removed from the container merely by removing the grill and releasing the latches if such are provided and then vertically lifting the case off the container. The container thus is fully exposed and further has no part of the humidifying mechanism secured to it so that it can be easily cleaned.

In order to assist the operator in removing the case from the container, a hand opening 106 is provided in the back panel between ledge 56 and fan opening wall 42. In the preferred embodiment, the case is formed of light weight plastic panels, and the humidifying mechanism is likewise not particularly heavy to allow the case to be easily handled with a minimum of physical exertion. The ease of separation of the case from the container should make the chore of cleaning the humidifier much more acceptable, which upon more frequent and regular cleaning of the unit will improve the overall operation of the humidifier.

What is claimed is:

1. A portable humidifier, in combination comprising a water container, case, and humidifying mechanism; said container being watertight and having a bottom wall and upstanding side walls and having means on the bottom wall adapted to rest on a supporting surface; said case having downwardly extended side walls defining an open bottom interior larger than the container and thereby being adapted to be vertically lowered to telescoping relation with the container for virtually hiding same or to be vertically lifted from the container, cooperating ledge means between the container and case operable for supporting the case on the container in the telescoped relation whereat the lower edges of the case side walls are disposed closely adjacent but spaced above the supporting surface, said ledge means including inwardly formed projections from the case side walls at intermediate locations spaced from the lower edges thereof which projections are adapted to overlie and butt against the top edge of the container side walls, said case further having spaced apart inlet and outlet openings communicating with the interior; and the humidifying mechanism being supported by the case and having fan means for moving air successively through the inlet and outlet openings and further having means exposed to the moving air between the inlet and outlet openings and having means extending into the water in the container wetting the air exposed means, and whereby said case is supported on the container and said humidifying mechanism is supported by the case and further whereby the case and the humidifying mechanism supported thereon can be readily separated from the container merely by lifting said case vertically from the container.

2. A portable humidifier according to claim 1, wherein said case further has a hand opening provided therein to assist the operator in removing the case from the container.

3. A portable humidifier according to claim 1, wherein said case has a decorative exterior.

4. A portable humidifier according to claim 1, wherein said humidifying mechanism is carried solely by the case and is virtually free of any connection with or to the container.

* * * * *